US007736173B2

(12) United States Patent
Chen

(10) Patent No.: US 7,736,173 B2
(45) Date of Patent: Jun. 15, 2010

(54) INSULATION DISPLACEMENT CONTACT (IDC) AND IDC MOUNTING SYSTEM

(75) Inventor: Chou-Hsing Chen, Keelung (TW)

(73) Assignee: Surtec Industries, Inc., Keelung (TW)

( * ) Notice: Subject to any disclaimer, the term of this patent is extended or adjusted under 35 U.S.C. 154(b) by 0 days.

(21) Appl. No.: 12/426,583

(22) Filed: Apr. 20, 2009

(65) Prior Publication Data

US 2010/0068916 A1 Mar. 18, 2010

Related U.S. Application Data

(63) Continuation-in-part of application No. 12/211,280, filed on Sep. 16, 2008.

(51) Int. Cl.
*H01R 4/24* (2006.01)

(52) U.S. Cl. ..... 439/395; 439/404

(58) Field of Classification Search ..... 439/395, 439/404, 825, 82, 76.1
See application file for complete search history.

(56) References Cited

U.S. PATENT DOCUMENTS

| | | | | | |
|---|---|---|---|---|---|
| 3,412,369 | A * | 11/1968 | Fox | 439/748 |
| 4,533,200 | A * | 8/1985 | Wilson | 439/395 |
| 4,826,449 | A * | 5/1989 | Debortoli et al. | 439/411 |
| 4,863,402 | A * | 9/1989 | Black et al. | 439/736 |
| 5,004,426 | A * | 4/1991 | Barnett | 439/82 |
| 5,533,910 | A * | 7/1996 | Korner et al. | 439/395 |
| 5,683,268 | A * | 11/1997 | Drach et al. | 439/404 |
| 5,759,061 | A * | 6/1998 | Jensen et al. | 439/402 |
| 6,093,048 | A * | 7/2000 | Arnett et al. | 439/404 |
| 6,142,817 | A * | 11/2000 | Lee | 439/395 |
| 6,168,478 | B1 * | 1/2001 | Daoud | 439/746 |
| 6,350,144 | B1 * | 2/2002 | Afflerbaugh et al. | 439/412 |
| 7,223,115 | B2 * | 5/2007 | Hashim et al. | 439/403 |
| 2004/0092153 | A1 * | 5/2004 | Peng | 439/404 |
| 2007/0190844 | A1 * | 8/2007 | Donhauser et al. | 439/395 |
| 2008/0293289 | A1 * | 11/2008 | Siev et al. | 439/404 |

* cited by examiner

*Primary Examiner*—Neil Abrams
*Assistant Examiner*—Harshad C Patel
(74) *Attorney, Agent, or Firm*—McGlew and Tuttle, P.C.

(57) ABSTRACT

An insulation displacement contact (IDC) is provided for use in a connector housing having an IDC receiving passage with insertion region first side edge and insertion region second side edge defining lower stops and upper locking catches. The IDC includes a base portion with a first IDC arm extending from the base portion and a second IDC arm extending from the base portion. The arms each have a lower portion with reduced dimension, a wire cutting/clamping region with an inner surface for insulated wire cutting and clamping, and an upper portion defining a region for introducing wires for termination. The IDC arms are flexible with respect to the base portion whereby the wire cutting/clamping regions cooperate for cutting and clamping insulated wires. The IDC has a first upper locator at an exterior surface of the first IDC arm, a second upper locator at an exterior surface of the first IDC arm, a second lower locator at an exterior surface of the IDC; and a second lower locator at an exterior surface of the IDC. The first lower locator and the second lower locator contact lower stops with the first upper locator engaging a first side upper locking catch and the second upper locator engaging a second side upper locking catch upon inserting the IDC into the IDC receiving passage.

12 Claims, 8 Drawing Sheets

INSULATION DISPLACEMENT CONTACT (IDC) AND IDC MOUNTING SYSTEM

CROSS REFERENCE TO RELATED APPLICATIONS

This is a continuation-in-part of and claims the benefit (35 U.S.C. §120) of copending U.S. application Ser. No. 12/211,280 filed Sep. 16, 2008, the entire contents of which are incorporated herein by reference.

FIELD OF THE INVENTION

The present invention relates to an insulation displacement contact (IDC) as well as to an IDC mounting system and connectors such as jacks and patch panels with IDCs according to the invention.

BACKGROUND OF THE INVENTION

Insulation displacement contacts (IDCs) have been used for many years for termination of wires in jacks, patch panels and similar terminal structures. The basic IDC structure includes a base part with two extending contact arms. Each contact arm cooperates with the other cutting arm to provide a cutting/clamping of an insulated wire. The cutting/clamping portion cuts and displaces insulation allowing the wire to contact the IDC to provide wire termination, namely a holding (clamping) of the wire with electrical contact.

SUMMARY OF THE INVENTION

According to the invention an insulation displacement contact is provided for use in a connector housing having an IDC receiving passage with insertion region first side edge and insertion region second side edge defining lower stops and upper locking catches. The insulation displacement contact includes a base portion with a first IDC arm extending from the base portion and a second IDC arm extending from the base portion. The arms each have a lower portion with reduced dimension, a wire cutting/clamping region with an inner surface for insulated wire cutting and clamping, and an upper portion defining a region for introducing wires for termination. The IDC arms are flexible with respect to the base portion whereby the wire cutting/clamping regions cooperate for cutting and clamping insulated wires. The IDC has a first upper locator at an exterior surface of the first IDC arm, a second upper locator at an exterior surface of the second IDC arm, a first lower locator at an exterior surface of the IDC; and a second lower locator at an exterior surface of the IDC. The first lower locator and the second lower locator contact lower stops with the first upper locator engaging a first side upper locking catch and the second upper locator engaging a second side upper locking catch upon inserting the IDC into the IDC receiving passage.

Each upper portion may advantageously include a hook portion defining a region between the arms for introducing and retaining wires for termination.

The base portion may advantageously include the first lower locator extending outwardly at a first side and the second lower locator extending outwardly at a second side.

A first side outer flexing contour may be formed between the first IDC arm and the base portion at the first side and a second side outer flexing contour may be formed between the second IDC arm and the base portion at the second side.

A first side inner flexing contour may be formed along the inner side of the lower portion with reduced dimension of the first IDC arm, between the wire cutting/clamping region and the first side outer flexing contour, and a second side inner flexing contour is formed along the inner side of the lower portion of the second IDC arm with reduced dimension between the wire cutting/clamping region and the first side outer flexing contour.

The IDC may have a mounting post portion extending from the base portion in a direction opposite to a direction of extension of the first IDC arm and the second IDC arm, the post for mounting the connector housing relative to a circuit board and electrically connecting the IDC to a circuit trace on the circuit board.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
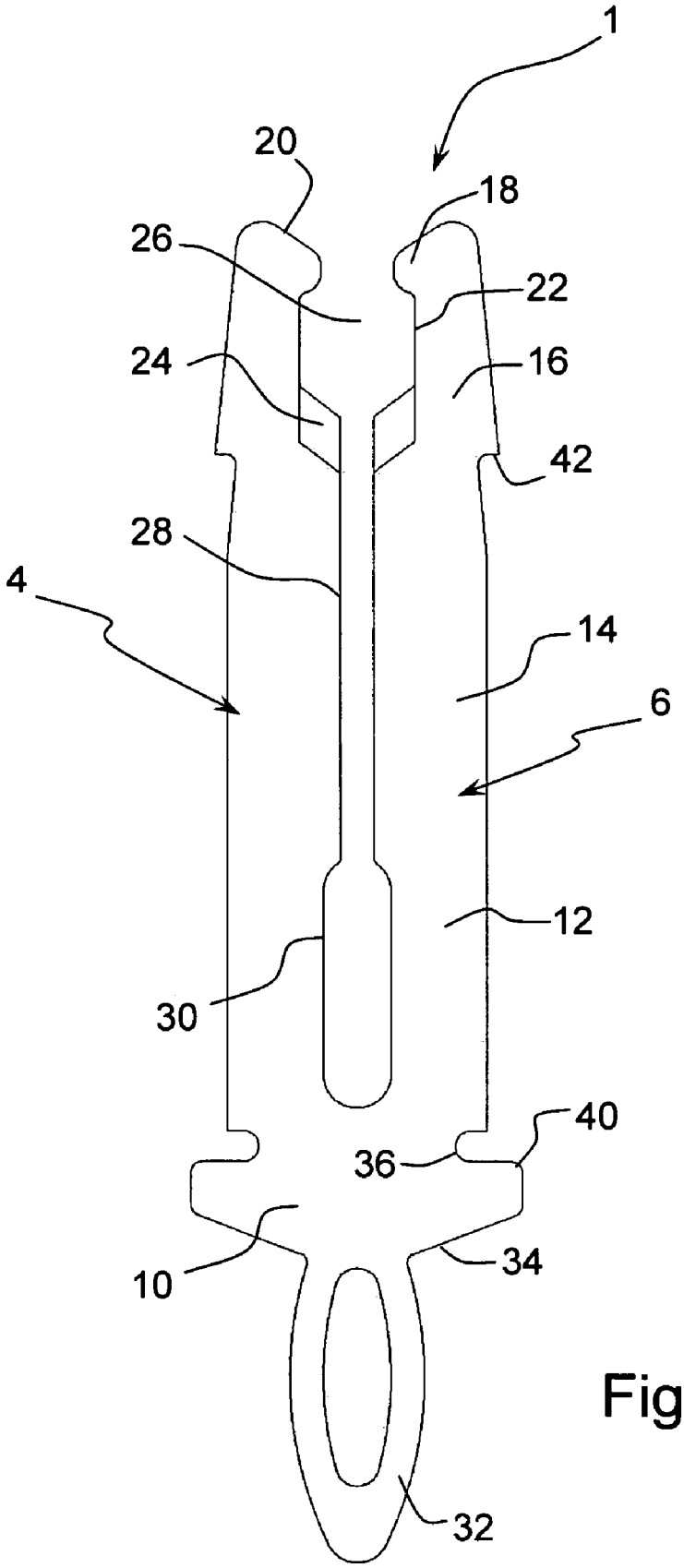
FIG. 1 is a front view of an IDC according to the invention.
Figure 2:
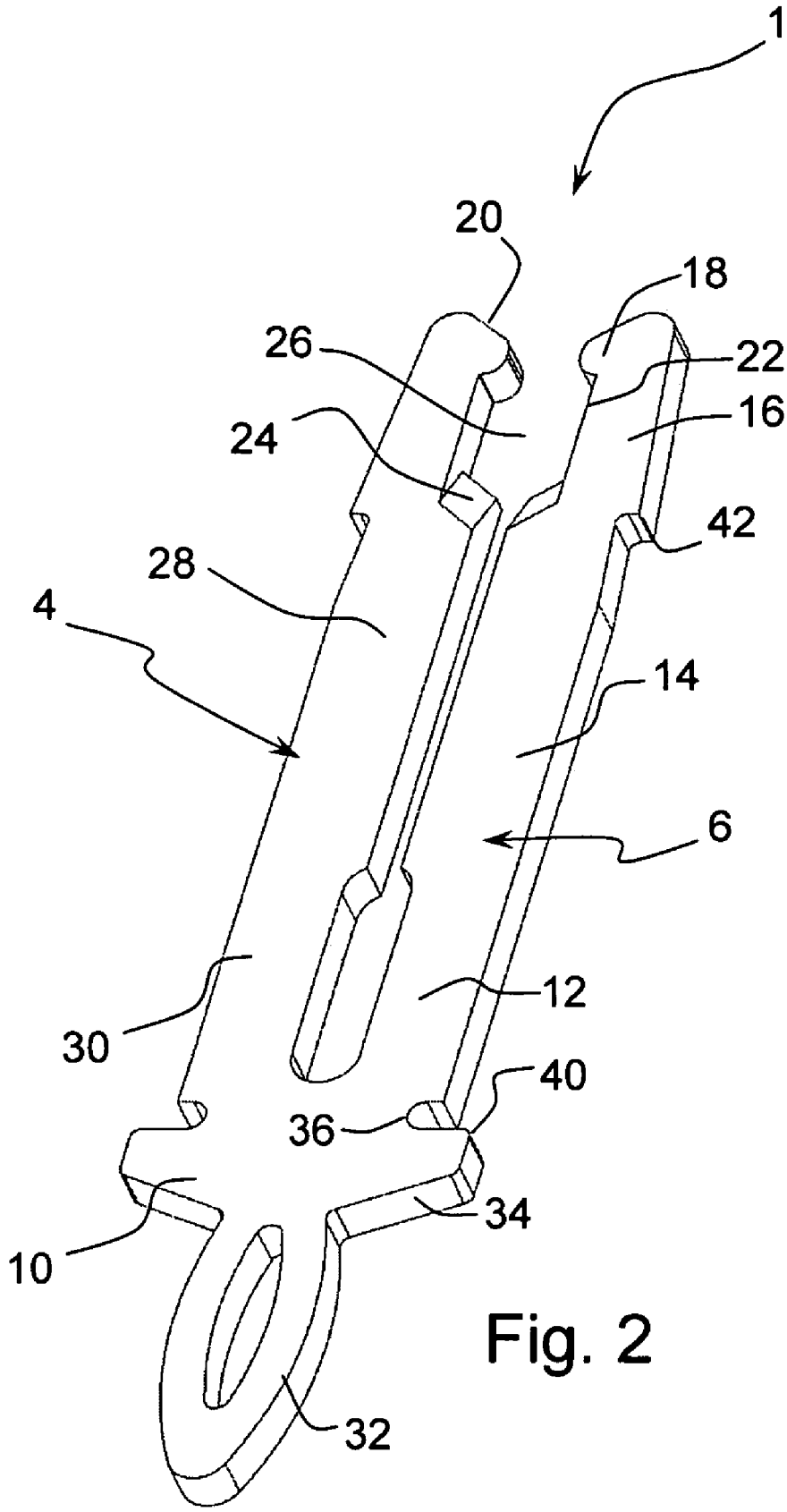
FIG. 2 is a perspective view of the IDC of FIG. 1.

Referring to the drawings in particular, FIG. 1 shows an IDC body 1 according to a first embodiment of the invention. The IDC body 1 has an IDC base portion 10 with a first side IDC arm 4 extending from the base portion 10 and a second side IDC arm 6 extending from the base portion 10. Each IDC arm 4, 6 includes a lower portion 12 with reduced inner edge to outer edge dimension, a wire cutting/clamping region 14 and an upper portion 16 for holding/receiving wires for termination. The upper portion 16 has a hook portion 18 and a tapered region 20. The tapered region 20 facilitates insertion of an insulated wire 302 into a wire holding/receiving region 26. The hook portion 18 and reduced dimension region 22 facilitate maintaining the position of an insulated wire in the wire holding/receiving region 26 so that it may be pressed so as to cut the insulation and clamp the wire 302 in a position electrically in contact with the IDC body 1. This allows the wires to be in a pre-termination position, ready to all be terminated by pressing them, for example with a tool as disclosed in U.S. application Ser. No. 12/211,280. The cutting is provided by angled cutting surfaces 24. The downward pressing of the insulated wire in the wire holding/receiving region 26 results in the wire 302 engaging the angled cutting surfaces 24, which pushes the first arm 4 and the second arm 6 apart as the insulation is cut. The wire is then clamped in the wire holding/receiving region 14 by the opposing clamping edges 28.

To allow a flexing of the first side arm 4 relative to the base 10 and to allow flexing of the second side arm 6 relative to the base 10, the lower portion 12 has a reduced dimension provided by the flexing region edge 30. A support post or mounting post 32 extends downwardly from the base part 10. The mounting post 32 is a so-called needle eye that provides a force fit with a plated through hole of a circuit board. The mounting post portion 32 is for mounting the IDC relative to a circuit board and electrically connecting the IDC to a circuit trace on the circuit board. As described further with respect to FIG. 3, the IDC is seated in a IDC plastic housing 61. The mounting post portion 32, cooperating with other mounting post portions 32 of other IDCs 1 that are seated in the same IDC plastic housing 61, provides a mounting and positioning of the IDC plastic housing 61 on the circuit board. The base of the IDC body 1 has a base edge 34, that is angled. This allows the IDC plastic housing 61 to contact a circuit board with little or no contact at the base edge 34 with the circuit board. A flexing contour 36 is provided at the outer edges of the IDC body 1 between the base portion 10 and the lower portion 12. This in cooperation with the flexing region edge 30 allows for adequate flexing of the first side arm 4 and the second side arm 6 relative to the base portion 10. The flexing contours 36 particularly allow an outward flexing of the first side arm 4 and the second side arm 6 relative to the base portion 10. The flexing regions 30 particularly allow an inward flexing of the first side arm 4 and the second side arm 6 relative to the base portion 10.

Figure 3:
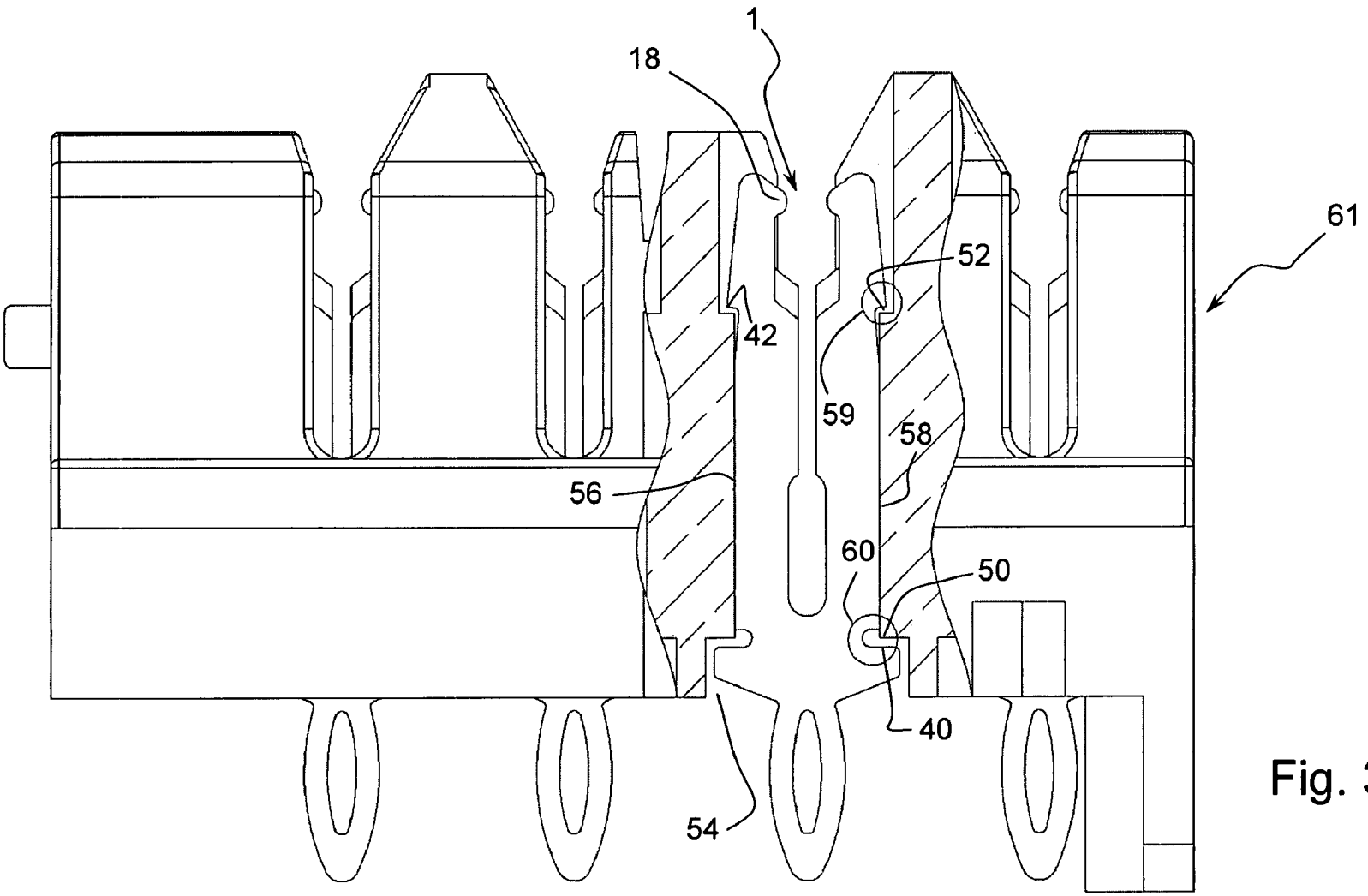
FIG. 3 is a partially sectional view showing the seated IDC of FIG. 1 locked into an IDC plastic housing.

An important aspect of the invention is the provision of snap in connection means for snap in seating in a position and snap in securing of the IDC relative to the connector housing. Upper and look lower locator portions in the form of an upper lock locator means 59 (second side shown in a circle) and a lower lock locator means 60 (second side shown in a circle) which provide a positioning and locking of each IDC 1 in an IDC insertion region 54 of the IDC plastic housing 61. The upper lock locator means 59 (second side shown in a circle) and a lower lock locator means 60 together from the snap in connection means for the IDC. The lock locator means 60 includes the provision of the base of the IDC body 1 with a lower locator (lock) 40 at each of the first side and the second side. As can be seen in FIG. 3 the IDC plastic housing 61 is provided with the IDC insertion region 54 having a first side and second side lower locator housing stop edge 50 as part of the means 60. The lock locator means 59 includes the first side arm 4 and the second side arm 6 each having an upper locator or lock portion 42. The insertion region 54 also has a first side and a second side upper locator housing catch edge 52 as part of the means 59. With this construction, the IDC body 1 is inserted into the insertion region 54. A first side edge 56 and a second side edge 58 of the insertion region 54 cause the first side arm 4 and the second side arm 6 to move inwardly relative to the base portion 10 until each upper locator 42 passes beyond the first side and second side catch edge 52. The first side arm 4 and second side arm 6 then move outwardly with each upper locator 42 blocking the movement of the IDC body 1 out of the insertion region 54. In this way, the lower locators 40 in cooperation with the lower locator housing edges 50 and the upper locator catches 42 in cooperation with the catch edges 52 maintain the IDC body 1 within the IDC plastic housing 61. This construction provides a locator function as the IDC body 1 is precisely located within the housing 61. The construction also provides a locking of the IDC body 1 in this position. This provides an efficient and accurate seating of the IDC body 1 in the plastic housing 61.

Figure 4:
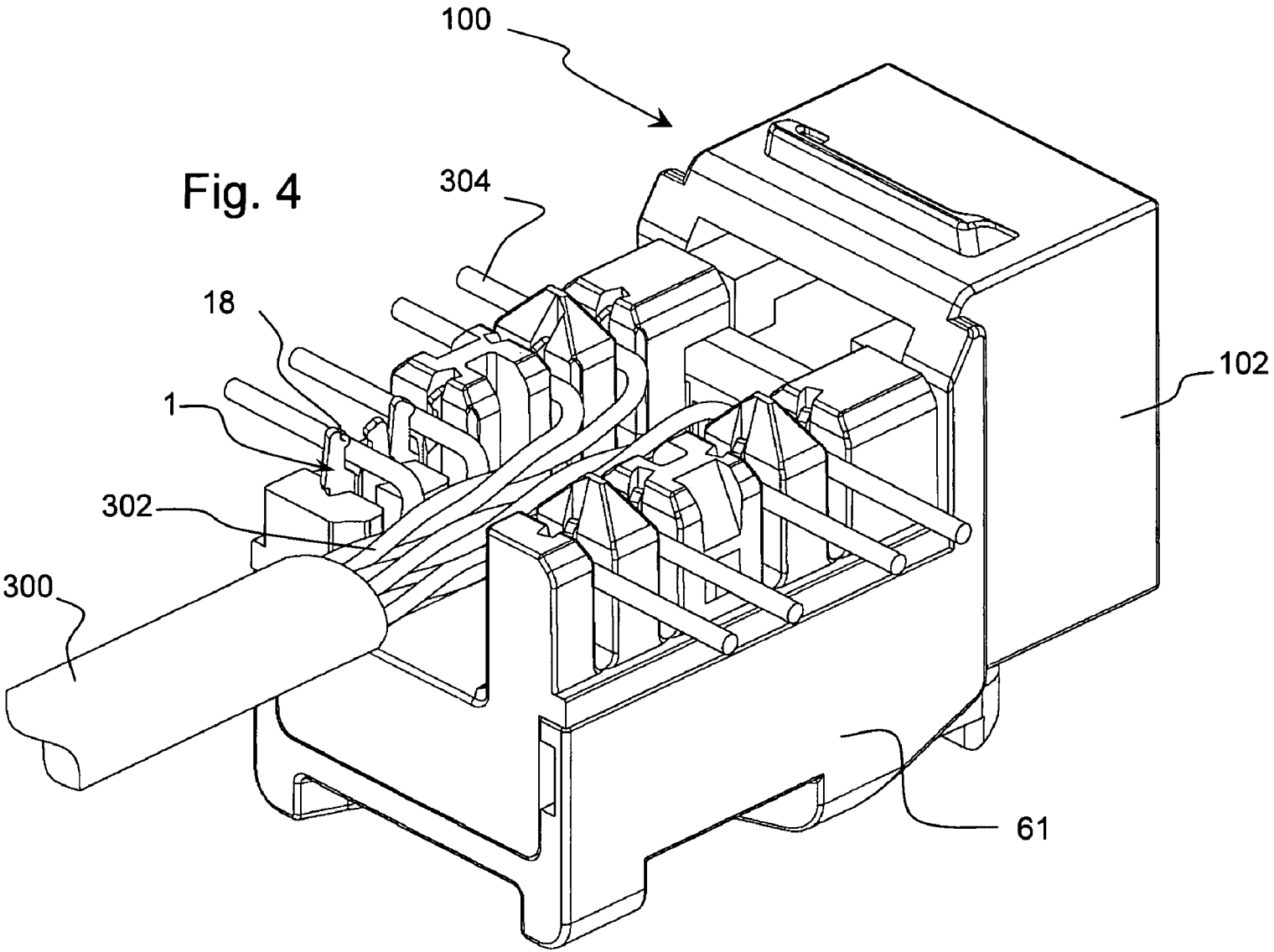
FIG. 4 is a perspective view of an RJ jack (90° RJ jack) with the IDC plastic housing of FIG. 3 and showing the IDCs holding wires in a position for wire termination.

FIG. 4 shows an RJ jack 100 with an RJ portion 102 provided with the IDC plastic housing 61. Each IDC 1 has hook portions 18 that retain a wire 302 in a position ready for termination. The plastic housing 61 has a central cable receiving region for a multi-wire cable 300. The wires 302 are held in the ready position above the cutting/clamping slot of a respective IDC 1 in an aligned position, with this facilitated by the hook portions 18. The wires 302 are moved to a final seated position with the wire terminated to a respective cutting/clamping slot clamping edge 28 of an IDC 1. A portion 304 of the wire 302 is preferably cut off by a cutting blade.

Figure 5:
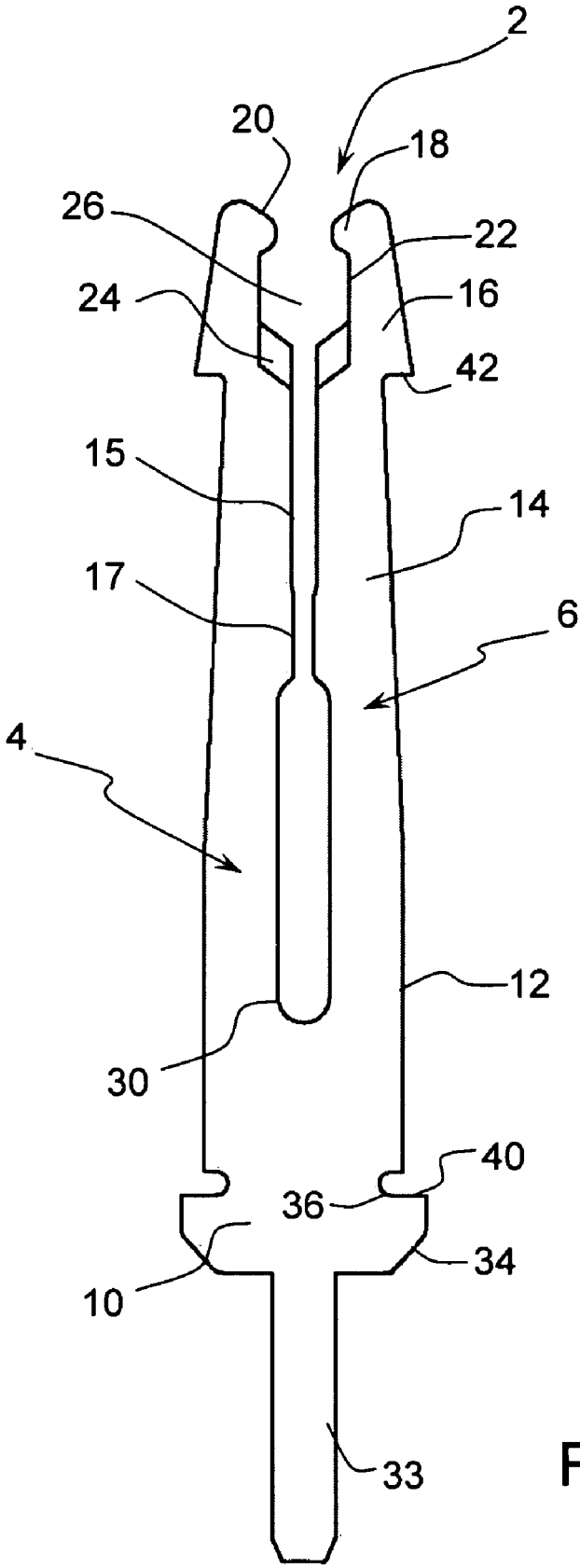
FIG. 5 is a front view of an IDC according to a second embodiment of the invention.

FIG. 5 shows an IDC body 2 according to a second embodiment of the invention. The IDC body 2 has an IDC base portion 10 with a first side IDC arm 4 extending from the base portion 10 and a second side IDC arm 6 extending from the base portion 10. Each IDC arm 4, 6 includes a lower portion 12 with reduced inner edge to outer edge dimension, a wire cutting/clamping region 14 and an upper portion 16 for holding/receiving wires for termination. The upper portion 16 has a hook portion 18 and a tapered region 20. The tapered region 20 facilitates insertion of an insulated wire into a wire holding/receiving region 26. The hook portion 18 and reduced dimension region 22 facilitate maintaining the position of an insulated wire in the wire holding/receiving region 26 so that it may be pressed so as to cut the insulation and clamp the wire in a position electrically in contact with the IDC body 2. This allows the wires to be in a pre-termination position, ready to be terminated by pressing them. The IDC body 2 has a similar base portion 10 and a similar but slightly longer lower portion 12. A similar wire cutting/clamping region 14 is provided that includes a clamping region 15 below the cutting surfaces 24. A flexing stop surface 17 is provided below the clamping region 15 and above the flexing region edge 30. The base 10 has a mounting post 33 of a generally cylindrical shape that can be soldered to a printed circuit board.

Figure 6:
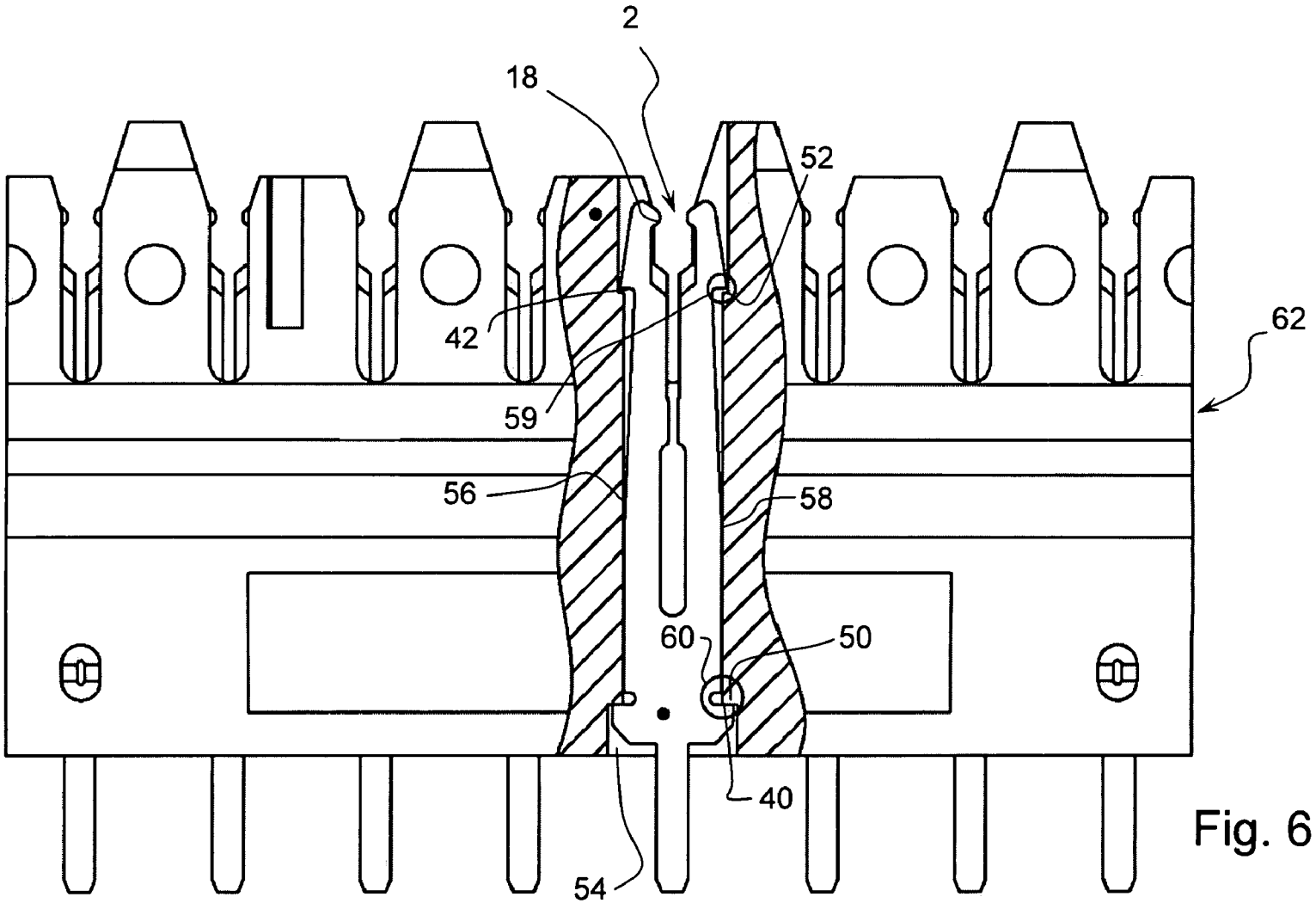
FIG. 6 is a partially sectional view showing a second embodiment of an IDC seated and locked into a second embodiment of an IDC plastic housing.

According to the second embodiment of the invention, as shown in FIG. 6, a plastic housing 62 is provided for receiving an IDC body 2. The plastic housing 62 is similar to the plastic housing 61. Cutting is provided by the angled cutting surfaces 24. The downward pressing of the insulated wire in the wire holding/receiving region 26 results in the wire (not shown) engaging the angled cutting surfaces 24, which pushes the first arm 4 and the second arm 6 apart as the insulation is cut. The wire is then clamped by clamping edges in the region 15.

In the same manner as described with regard to the embodiment of FIG. 3, the arrangement of FIG. 6 includes the upper lock locator means 59 (second side shown in a circle) and the lower lock locator means 60 together forming the snap in connection means for the IDC. The IDC body 2 is inserted into the insertion region 54 of the IDC plastic housing 62. A first side edge 56 and a second side edge 58 of the insertion region 54 cause the first side arm 4 and the second side arm 6 to move inwardly relative to the base portion 10 until each upper locator 42 passes beyond the first side and second side catch edge 52. The first side arm 4 and second side arm 6 then move outwardly with each upper locator 42 blocking the movement of the IDC body 1 out of the insertion region 54. In this way the lower locators 40 in cooperation with the lower locator housing edges 50 and the upper locator catches 42 in cooperation with the catch edges 52 maintain the IDC body 2 within the IDC plastic housing 62. This construction provides a locator function as the IDC body 2 is precisely located within the housing 62. The construction also provides a locking of the IDC body 2 in this position. This provides an efficient and accurate seating of the IDC body 2 in the plastic housing 62.

Figure 7:
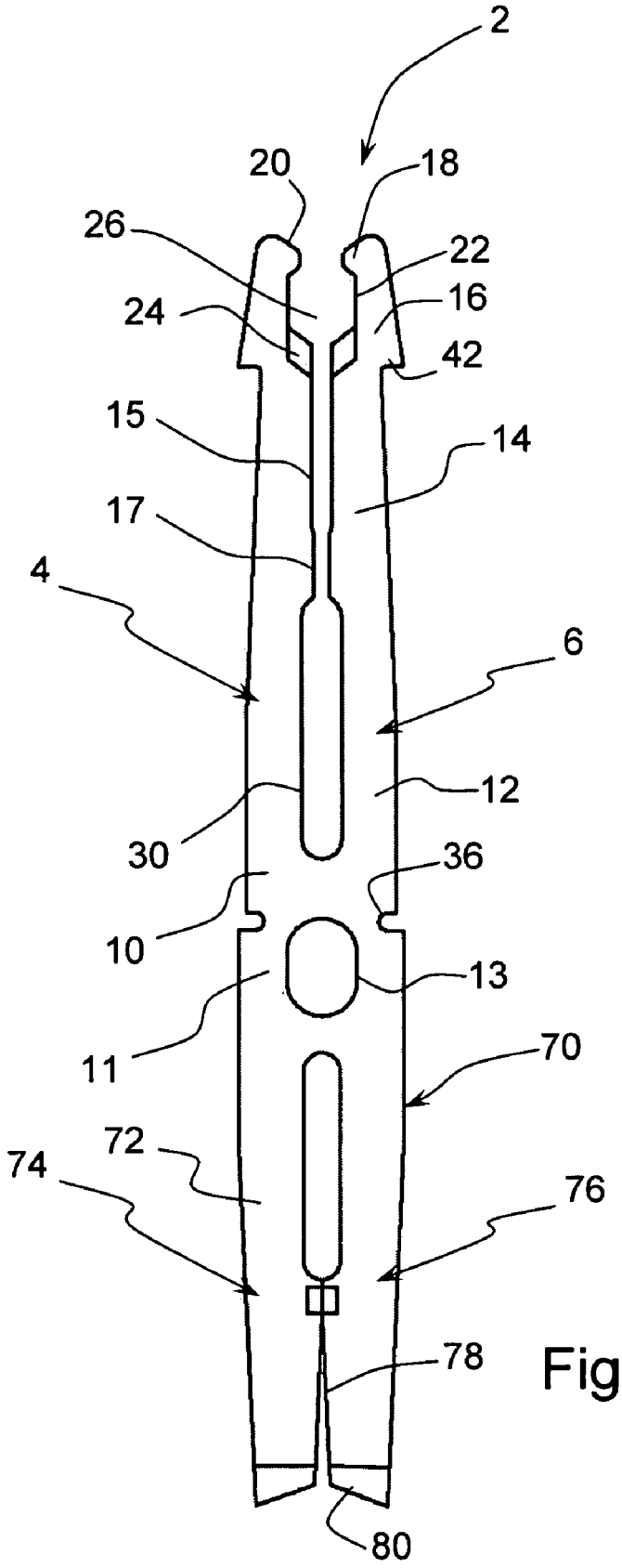
FIG. 7 is a front view of an IDC according to a third embodiment of the invention.

FIG. 7 shows an IDC body 3 according to a third embodiment of the invention. The IDC body 3 includes a wire cutting/clamping zone above the base portion 10 that is a very similar to the IDC body 2 of the second embodiment. A similar wire cutting/clamping region 14 is provided that includes a clamping region 15 below the cutting surfaces 24. A flexing stop surface 17 is provided below the clamping region 15 and above the flexing region edge 30. Unlike the other embodiments, the plastic housing 63 (FIG. 8) provides for wire termination at each of two ends of the IDC 3. For this, the IDC body 3 includes an intermediate portion 11 with lower locators 40 positioned near a central opening 13. In a region of the lower locators 40 there is a flexing contour 36 at each of the first and second side of the IDC body 3. A lower IDC portion 70 is provided extending downwardly from the intermediate portion 11. The lower IDC portion 70 includes a first side lower IDC arm 74 and a second side lower IDC arm 76. Each arm 74 and 76 has a reduced dimension portion 72, which facilitates movement or flexing of the first side arm 74 and the second side arm 76. Angled cutting surfaces 80 are provided at a low end of the IDC body 3. The angled cutting surfaces 80 lead to a clamping zone 78. The lower IDC portion 70 forms the IDC of the housing (punch down block) 63 (e.g., for an ATT 110 block).

The IDC body 3 has a IDC base portion 10 with a first side IDC arm 4 extending from the base portion 10 and a second side IDC arm 6 extending from the base portion 10. Each IDC arm 4, 6 includes a lower portion 12 with reduced inner edge to outer edge dimension, a wire cutting/clamping region 14 and an upper portion 16 for holding/receiving wires for termination. The upper portion 16 has a hook portion 18 and a tapered region 20. The tapered region 20 facilitates insertion of an insulated wire into a wire holding/receiving region 26. The hook portion 18 and reduced dimension region 22 facilitate maintaining the position of an insulated wire in the wire holding/receiving region 26 so that it may be pressed so as to cut the insulation and clamp the wire in a position electrically in contact with the IDC body 3.

Figure 8:
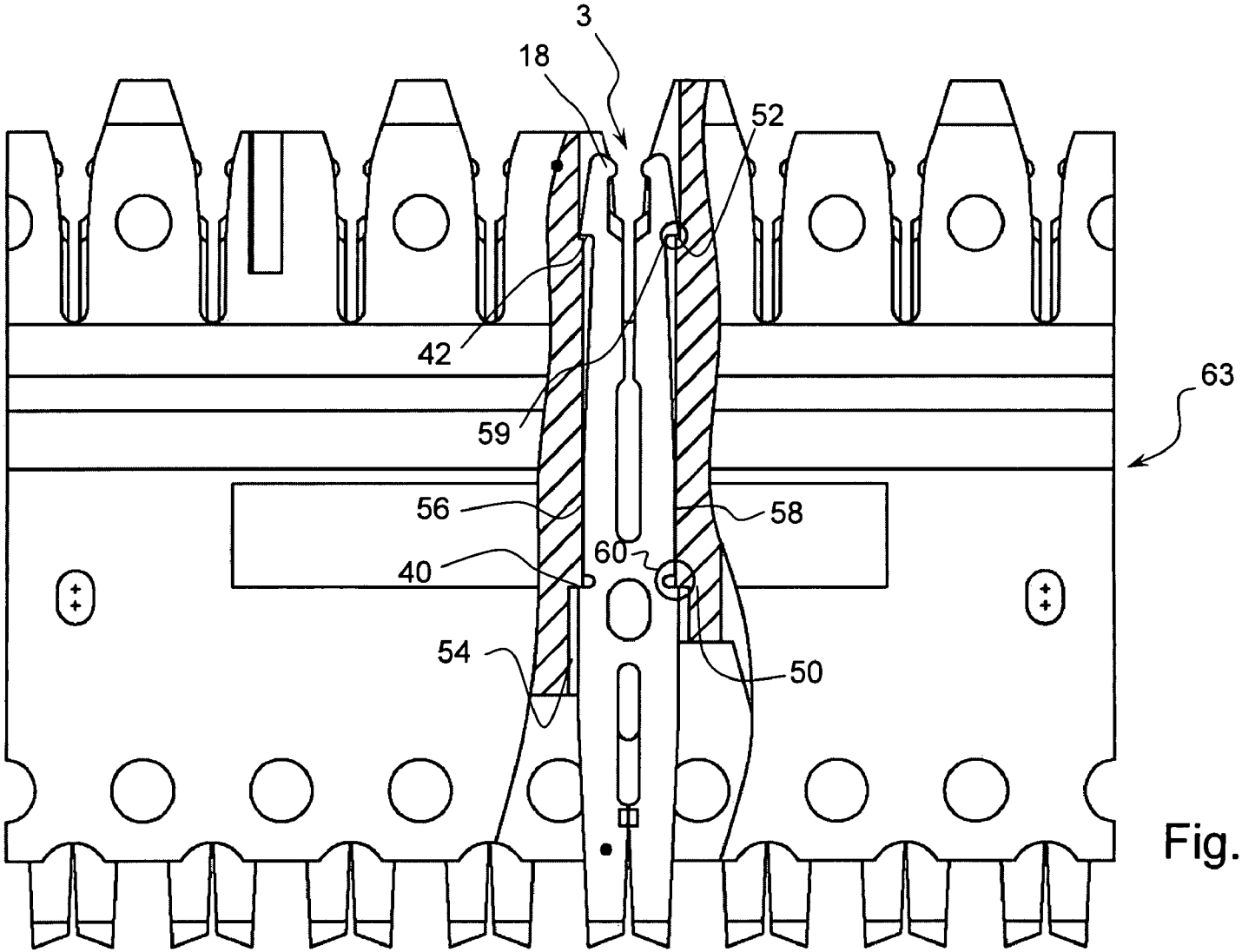
FIG. 8 is a partially sectional view showing a third embodiment of an IDC seated and locked into a third embodiment of an IDC plastic housing.

According to a third embodiment of the invention, as shown in FIG. 8, a plastic housing (punch down block) 63 is provided for receiving an IDC body 3. In the same manner as described with regard to the other embodiments, the arrangement of FIG. 8 includes the upper lock locator means 59 (second side shown in a circle) and the lower lock locator means 60 together forming the snap in connection means for the IDC. The IDC body 3 is inserted into the insertion region 54 of the IDC plastic housing 63. A first side edge 56 and a second side edge 58 of the insertion region 54 cause the first side arm 4 and the second side arm 6 to move inwardly relative to the base portion 10 until each upper locator 42 passes beyond the first side and second side catch edge 52. The first side arm 4 and second side arm 6 then move outwardly with each upper locator 42 blocking the movement of the IDC body 3 out of the insertion region 54. In this way the lower locators 40 in cooperation with the lower locator housing edges 50 and the upper locator catches 42 in cooperation with the catch edges 52 maintain the IDC body 3 within the IDC plastic housing 63 in a proper seated position. This construction provides a locator function as the IDC body 3 is precisely located within the housing 63. The construction also provides a locking of the IDC body 3 in this position. This provides an efficient and accurate seating of the IDC body 3 in the plastic housing 63.

While specific embodiments of the invention have been described in detail to illustrate the application of the principles of the invention, it will be understood that the invention may be embodied otherwise without departing from such principles.

What is claimed is:

1. An insulation displacement contact (IDC) for being seated in a connector housing having an IDC receiving passage with lower stops and upper locking catches, the insulation displacement contact comprising:

a base portion;

a first IDC arm extending from said base portion and including a lower portion with reduced dimension, a wire cutting/clamping region with an inner surface for insulated wire cutting and clamping, and an upper portion with a hook shaped portion defining a region for introducing wires for termination;

a second IDC arm extending from said base portion and including a lower portion with reduced dimension, a wire cutting/clamping region with an inner surface for insulated wire cutting and clamping, and an upper portion with a hook shaped portion defining a region for introducing wires for termination, each of said first IDC arm and said second IDC being flexible with respect to said base portion whereby said wire cutting/clamping regions cooperate for cutting and clamping insulated wires;

a first upper locator at an exterior surface of said first IDC arm;

a second upper locator at an exterior surface of said second IDC arm;

a first lower locator at an exterior surface of the IDC;

a second lower locator at an exterior surface of the IDC, said first lower locator and said second lower locator contacting the lower stops with said first upper locator engaging a first side upper locking catch and said second upper locator engaging a second side upper locking catch upon inserting the IDC into the IDC receiving passage.

2. An insulation displacement contact according to claim 1, wherein said base portion includes the first lower locator extending outwardly at a first side and the second lower locator extending outwardly at a second side.

3. An insulation displacement contact according to claim 2, wherein a first side outer flexing contour is formed between said first IDC arm and said base portion at the first side and a second side outer flexing contour is formed between said second IDC arm and said base portion at the second side.

4. An insulation displacement contact according to claim 3, wherein a first side inner flexing contour is formed along the inner side of said lower portion with reduced dimension of said first IDC arm, between said wire cutting/clamping region and said first side outer flexing contour, and a second side inner flexing contour is formed along the inner side of said lower portion of said second IDC arm with reduced dimension between said wire cutting/clamping region and said first side outer flexing contour.

5. An insulation displacement contact according to claim 1, further comprising:

a mounting post portion extending from said base portion in a direction opposite to a direction of extension of said first IDC arm and said second IDC arm, said post for mounting the connector housing relative to a circuit board and electrically connecting the IDC to a circuit trace on the circuit board.

6. An insulation displacement contact and connector housing combination comprising:

a connector housing having an IDC receiving passage with insertion region first side edge and insertion region second side edge defining lower stops and upper locking catches; and an insulation displacement contact comprising:

a base portion;

a first IDC arm extending from said base portion and including a lower portion with reduced dimension, a wire cutting/clamping region with an inner surface for insulated wire cutting and clamping, and an upper portion defining a region for introducing wires for termination;

a second IDC arm extending from said base portion and including a lower portion with reduced dimension, a wire cutting/clamping region with an inner surface for insulated wire cutting and clamping, and an upper portion defining a region for introducing wires for termination, each of said first IDC arm and said second IDC being flexible with respect to said base portion whereby said wire cutting/clamping regions cooperate for cutting and clamping insulated wires;

an first upper locator at an exterior surface of said first IDC arm;

an second upper locator at an exterior surface of said first IDC arm;

an first lower locator at an exterior surface of the IDC;

an second lower locator at an exterior surface of the IDC, said first lower locator and said second lower locator contacting the lower stops with said first upper locator engaging a first side upper locking catch and said second upper locator engaging a second side upper locking catch upon inserting the IDC into the IDC receiving passage.

7. A combination according to claim 6, wherein each upper portion includes a hook portion defining a region between the arms for introducing and retaining wires for termination.

8. A combination according to claim 6, wherein said base portion includes the first lower locator extending outwardly at a first side and the second lower locator extending outwardly at a second side.

9. A combination according to claim 8, wherein a first side outer flexing contour is formed between said first IDC arm and said base portion at the first side and a second side outer flexing contour is formed between said second IDC arm and said base portion at the second side.

10. A combination according to claim 9, wherein a first side inner flexing contour is formed along the inner side of said lower portion with reduced dimension of said first IDC arm, between said wire cutting/clamping region and said first side outer flexing contour, and a second side inner flexing contour is formed along the inner side of said lower portion of said second IDC arm with reduced dimension between said wire cutting/clamping region and said first side outer flexing contour.

11. A combination according to claim 6, further comprising:

a mounting post portion extending from said base portion in a direction opposite to a direction of extension of said first IDC arm and said second IDC arm, said post for mounting the connector housing relative to a circuit board and electrically connecting the IDC to a circuit trace on the circuit board.

12. An insulation displacement contact and connector housing combination comprising:

a connector housing having an IDC receiving passage with insertion region first side edge and insertion region second side edge defining lower stops and upper locking catches; and an insulation displacement contact comprising:

a base portion;

a first IDC arm extending from said base portion and including a lower portion with reduced dimension, a wire cutting/clamping region with an inner surface for insulated wire cutting and clamping, and an upper portion defining a region for introducing wires for termination;

a second IDC arm extending from said base portion and including a lower portion with reduced dimension, a wire cutting/clamping region with an inner surface for insulated wire cutting and clamping, and an upper portion defining a region for introducing wires for termination, each of said first IDC arm and said second IDC being flexible with respect to said base portion whereby said wire cutting/clamping regions cooperate for cutting and clamping insulated wires; and snap in connection means for snap in seating in a position and snap in securing of the IDC relative to the connector housing wherein:

said snap in connection means comprises an upper lock locator means and a lower lock locator means said upper lock locator means comprises a first upper locator at an exterior surface of said first IDC arm and a second upper locator at an exterior surface of said second IDC arm, said first upper locator engaging a first side upper locking catch of said housing and said second upper locator engaging a second side upper locking catch of said housing, upon inserting the IDC into the IDC receiving passage; and said lower lock locator means comprises a first lower locator at an exterior surface of the first IDC arm and a second lower locator at an exterior surface of the second IDC arm, said first lower locator and said second lower locator contacting lower stops defines by said housing.

* * * * *